United States Patent [19]

Ventress

[11] Patent Number: 4,898,018

[45] Date of Patent: Feb. 6, 1990

[54] STRUT STRAIGHTENING DEVICE

[76] Inventor: Ray Ventress, 10512 - 135A Street, Surrey, British Columbia V4A 4C8, Canada

[21] Appl. No.: 209,646

[22] Filed: Jun. 21, 1988

[30] Foreign Application Priority Data

Feb. 5, 1988 [CA] Canada ..... 565718

[51] Int. Cl.[4] ..... B21D 1/12

[52] U.S. Cl. ..... 72/457; 72/705

[58] Field of Search ..... 72/705, 447, 457, 704, 72/461

[56] References Cited

U.S. PATENT DOCUMENTS

| | | | |
|---|---|---|---|
| 3,224,730 | 12/1965 | Fischler | 72/705 |
| 3,340,720 | 9/1967 | Chartier | 72/705 |
| 4,103,531 | 8/1978 | Daniel | 72/704 |
| 4,117,709 | 10/1978 | Jackson | 72/704 |
| 4,151,737 | 5/1979 | Specktor | 72/705 |
| 4,158,303 | 6/1979 | Horn et al. | 72/705 |
| 4,178,791 | 12/1979 | Daniel | 72/704 |
| 4,296,626 | 10/1981 | Jarman et al. | 72/705 |
| 4,337,636 | 7/1982 | Clausen | 72/705 |
| 4,388,820 | 6/1983 | Rickbeil | 72/704 |
| 4,455,859 | 6/1984 | Yamada | 72/447 |
| 4,462,241 | 7/1984 | Whisenant | 72/704 |
| 4,485,662 | 12/1984 | Justice | 72/704 |
| 4,555,927 | 12/1985 | Grace | 72/705 |

OTHER PUBLICATIONS 3,016,089, Nov. 1981, German Pub. Application; 4 sheets of drwgs. and 18 pages of Spec.

3,215,420, May 1983, German Published Application; 8 sheets of drwgs. and 11 pages of Spec.

0163216, Pub. Dec. 1985, Euro. Pat. Application; 3 sheets of drwgs. and 6 pages of Spec.

*Primary Examiner*—Robert L. Spruill

*Attorney, Agent, or Firm*—Christie, Parker & Hale

[57] ABSTRACT

An apparatus for straightening an unmounted automotive component. The apparatus has a pneumatic pull tower mounted at one end of a base and a first pulley mounted on a movable ram sleeve in the tower. A second pulley is movably mounted along the tower. A component securing device is mounted at another end of the base and can receive and hold the component. A first chain can be connected at one end to the component and at another end to the base. The chain is led along the first and second pulleys such that when the pneumatic pull tower is activated, the ram sleeve will apply a force on the chain to straighten the component.

18 Claims, 5 Drawing Sheets

16
12
119
66
46
88
119
66
68
20
22
80
10
120
52
56
108
18
85
84
64
108
82
86
116
110
110
118
14
76
60
79
58
74
77
112
62
100
90
96
98
102
94
104

119
66
66
120
119
70
66
68
72
120
68
70
66
56
64
58
14
116
118
76
74
62
78
77
79
79

STRUT STRAIGHTENING DEVICE

FIELD OF THE INVENTION

This invention relates to devices for straightening an unmounted automotive steering component, for example, McPherson struts.

McPherson struts are by far the most common means of ensuring independent front suspension on modern vehicles and are also used extensively as rear suspension components in imported vehicles, particularly from Japan. When used in the rear suspension they are often referred to as Chapman struts.

When a car having such struts is involved in an accident or simply through sag due to hitting pot holes, the struts can bend either at the axle spindle, which is, of course, an integral part of the strut or the tubing that houses the cartridge can be bent and on front wheel drive autos it could be the knuckle that would be affected.

DESCRIPTION OF THE PRIOR ART

A number of prior art devices have been disclosed in the past for use in straightening and repairing the body and frame of vehicles as well as McPherson struts. For example, U.S. Pat. No. 4,151,737 which issued to Specktor discloses an apparatus for repairing and straightening the body and frame of a vehicle that includes three hydraulically operated, elongatable pull towers. A chain transmits the pulling force of the tower to a damaged automobile body which is positioned on tracks.

U.S. Pat. No. 4,103,531 teaches a method and apparatus for correcting bent strut misalignment that does not require removal of the strut from the vehicle. In one embodiment the strut is retained in a strut clamp and a lower arm clamp and a wheel holder is positioned beside the point to be bent. A force is then applied by a jack to to the wheel hub via the wheel holder.

U.S. Patent No. 4,117,709 discloses a camber adjusting tool that attaches to the hub of the wheel by means of a base and uses a hydraulic ram to straighten the strut.

U.S. Pat. No. 4,178,791 teaches a method and apparatus for correcting bent axle misalignment that employs a hydraulic ram.

U.S. Pat. No. 4,296,626 discloses a wheel alignment apparatus for a McPherson strut front suspension assembly that comprises a strut tower mounting plate, a lower brace assembly with a hub adapting plate and a retractable hydraulic ram. A turn buckle type strut member is also secured to each strut tower and can be used to aid enforcing apart or pulling together the towers.

U.S. Pat. No. 4,462,241 discloses a wheel alignment device which transmits the pulling force of a jack through a chain attached to a tension arm.

U.S. Pat. No. 4,485,662 discloses a suspension strut adjusting tool which uses a pair of hydraulic rams.

U.S. Pat. No. 4,388,820 teaches a camber correction tool using a hydraulic ram, an upstanding support and a pivotal frame. The end of the frame is connected to the wheel mounting plate of the vehicle and corrective forces are applied by a ram.

The problem associated with those prior art devices is that a force is applied between the flange plate and the tube. Also, no consideration is given to the actual area of deformation prior to restoration procedure being initiated. These deformations depend on the method of mounting to the vehicle and the manner in which the extraneous force is exerted. For example, if a vehicle contacts the curb with moderate force, the usual deformation that occurs to the McPherson unit is limited to the spindle, between the wheel bearings, and on front wheel drive cars the knuckle, but related components such as the ball joint shaft, control arm, cross member or radius rod can also sustain damage. In order to inspect the ball joint for defects, it is necessary to remove it from the assembly. If this is not done, then, when using the prior art devices, a compensating bend would have to be made to the tube in order to restore the correct camber to the wheel unit. This causes accelerated wear of the bearings and uneven wear of the brakes as the caliper to spindle alignment would be incorrect. This could eventually lead to an unsafe condition as there would be a tendency for the vehicle to swerve when braking.

On the other hand, if the wheel sustained force to the upper part, there is a possibility of a bent shock absorber shaft or tube and related components such as the upper bearing and tower. In order to thoroughly check and inspect for obscure defects, as well as facilitating removal of the spring from the strut to check the bearing and shaft, it is necessary to remove the strut from the vehicle.

The prior art devices have but one objective, that is to effect an "in situ" correction to the camber of the vehicle wheels without having too much concern as to whether or not it is in fact an accurate and effective repair that will not induce future faults affecting the safe operation of the vehicle. In these instances it is not possible to check fully for hidden defects, test for failures or accomplish precision adjustment without removing the unit from the vehicle and dismantling as required to ensure a conscientious and comprehensive repair. Also, straightening of forward and backward bends in McPherson struts cannot be achieved in the prior art equipment.

Accordingly, there is a need for a strut straightening apparatus which can straighten a strut tube without the use of a flange plate. There also is a need for an apparatus able to straighten forward and backward bends in McPherson struts.

It is therefore an object of the present invention to provide an apparatus able to straighten unmounted McPherson struts by using a novel means of securing the McPherson strut to the straightening apparatus.

Another object of the present invention is to provide a McPherson strut straightening apparatus which incorporates means for unloading the spring of the strut at the start of the process and able to reload it upon completion.

Another object of the present invention is to provide a method of straightening McPherson struts in which a hydraulic pull post applies a force by use of a chain attached to the strut upper tube only.

Yet another object of the present invention is to provide a method of straightening bent spindles of McPherson struts in which a hub flange plate is mounted to the hub of the McPherson strut and pull post is used to adjust the spindle alignment without using the tube for leverage.

SUMMARY OF THE INVENTION

Accordingly, an aspect of the present invention is to provide an apparatus for straightening an unmounted automotive component comprising:

a pneumatic pull tower mounted at one end of a base and having a first pulley mounted on a movable ram sleeve in said tower and a second pulley movably mounted along said tower;

component securing means mounted at another end of said base and adapted to fixedly receive said component;

a first chain for connecting at one end to said component and at another end to said base, said chain being led along said first and second pulleys such that when said pneumatic pull tower is activated, said ram sleeve will apply a force on said chain to straighten said component.

DRAWINGS

Particular embodiments of the invention will be understood in conjunction with the accompanying drawings in which.

DESCRIPTION OF THE PREFERRED EMBODIMENTS

Figure 1:
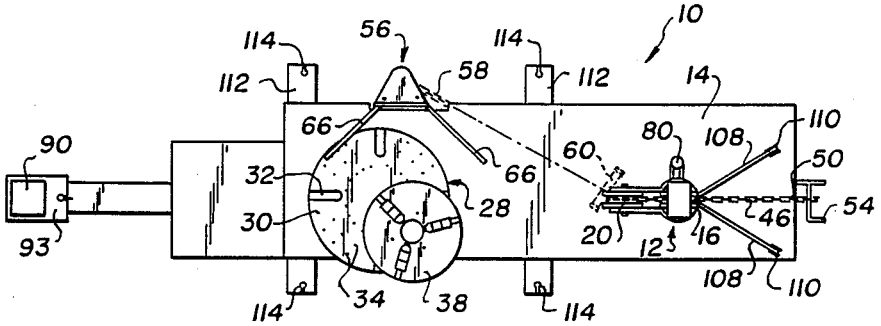
FIG. 1 is a plan view of the apparatus of the present invention.

The drawings show an apparatus 10 for straightening an unmounted automotive suspension component, particularly struts and steering components, comprising a pneumatic pull tower 12 mounted at one end of a base 14. There is a first pulley 16 mounted on a movable ram sleeve 18 in the tower 12 and a second pulley 20 mounted along the tower 12. The second pulley 20 is mounted on a sleeve 22 attached to the exterior of the tower 12. The pull tower 12 houses a driving cylinder comprising a pneumatic cylinder 24 to which there is an air supply 26. The ram 27 of the cylinder 24 contacts sleeve 25 upon which the pulley 16 is mounted.

Figure 2:
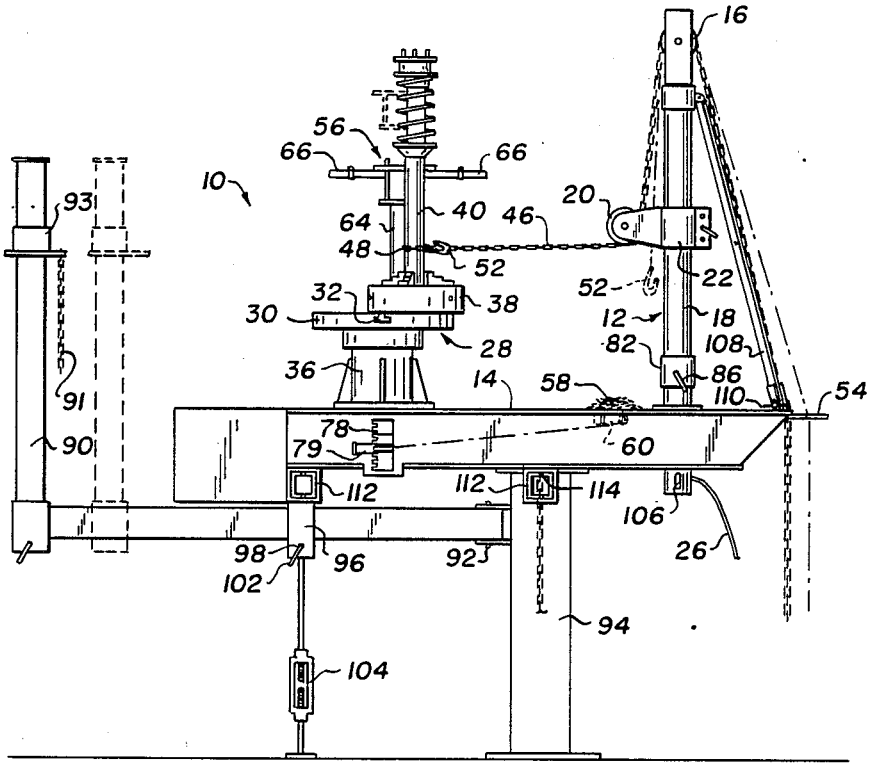
FIG. 2 is a side elevation of the apparatus with a strut in place.
Figure 6:
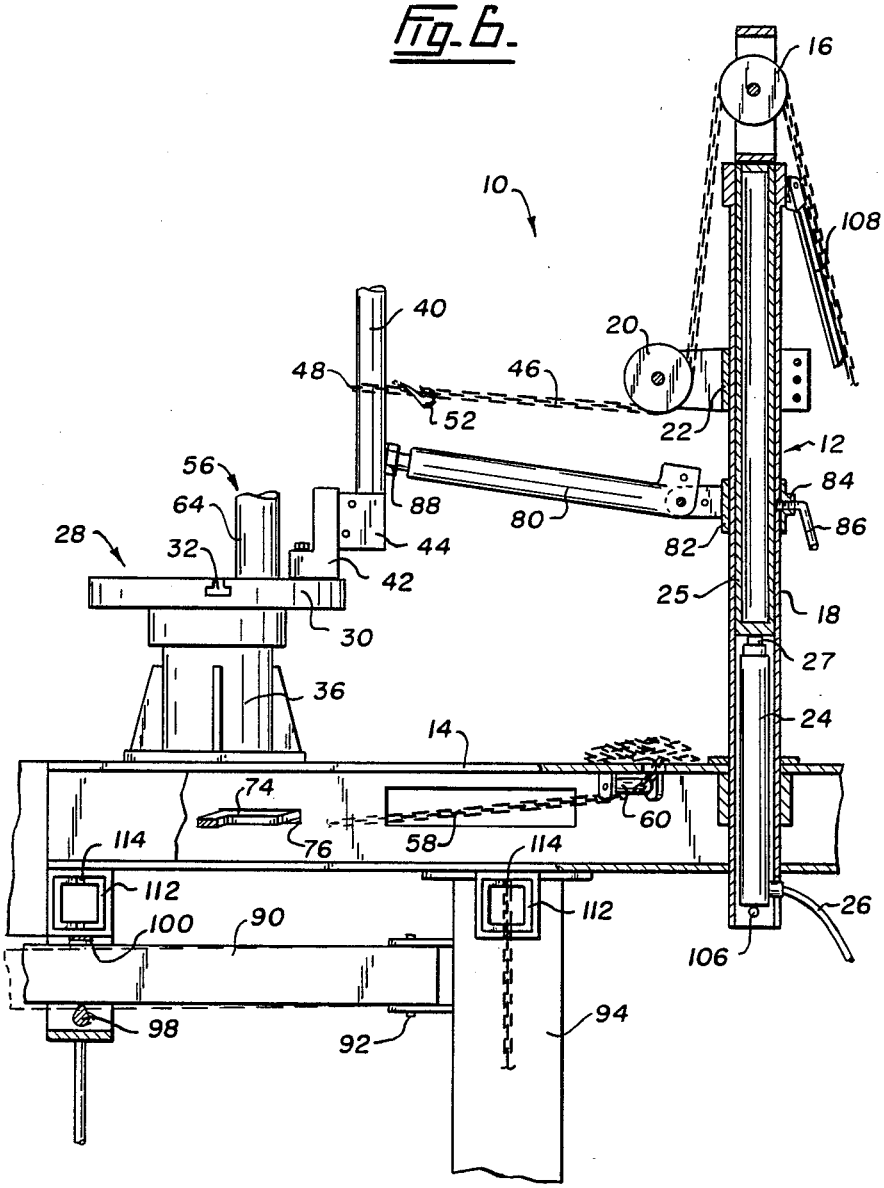
FIG. 6 is a detail of the apparatus in use.

There is a component securing means 28 mounted at the other end of the base 14 upon which the automotive component that is being worked on is mounted. As shown particularly in FIGS. 1, 2 and 6 the component securing means 28 comprises a table 30 provided with slots 32 of a generally T-shaped configuration. The arrangement is such that a variety of component gripping elements having correspondingly T-shaped projections can be positioned in a slot 32 and locked into position. Furthermore, as shown generally in FIG. 1 the table 30 has a plurality of openings 34 to which components can be bolted. The table 30 is mounted on a tower 36 that can be rotated and locked in a predetermined position. FIGS. 1 and 2 show the mounting of a chuck 38 on the table 30. FIG. 2 in particular shows the use of a chuck 38 to secure a McPherson strut 40, without bracket or knuckle. FIG. 6 illustrates the use of a mounting member 42 and table 30 to receive a McPherson strut 40 with a lower bracket 44. The lower bracket 44 of a McPherson strut is not usually removable from the strut.

Figure 4:
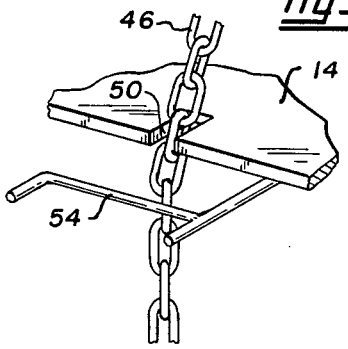
FIG. 4 illustrates a detail of an anchor point of the apparatus of FIG. 1.

A first chain 46 can be connected at one end 48 to a component 40 as shown particularly in FIGS. 2 and 6. The chain 46 extends from an anchor point 50, as shown in detail in FIG. 4, at one end of the base 14, upwardly over pulley 16, downwardly through sleeve 22, over the second pulley 20 and extends round the component 40. It is provided with a hook 52 so that the chain 46 may engage on itself. It should be noted from FIG. 4 that the base 14 is provided with a bracket 54 which acts to prevent the chain leaving the anchor point 50.

Figure 7:
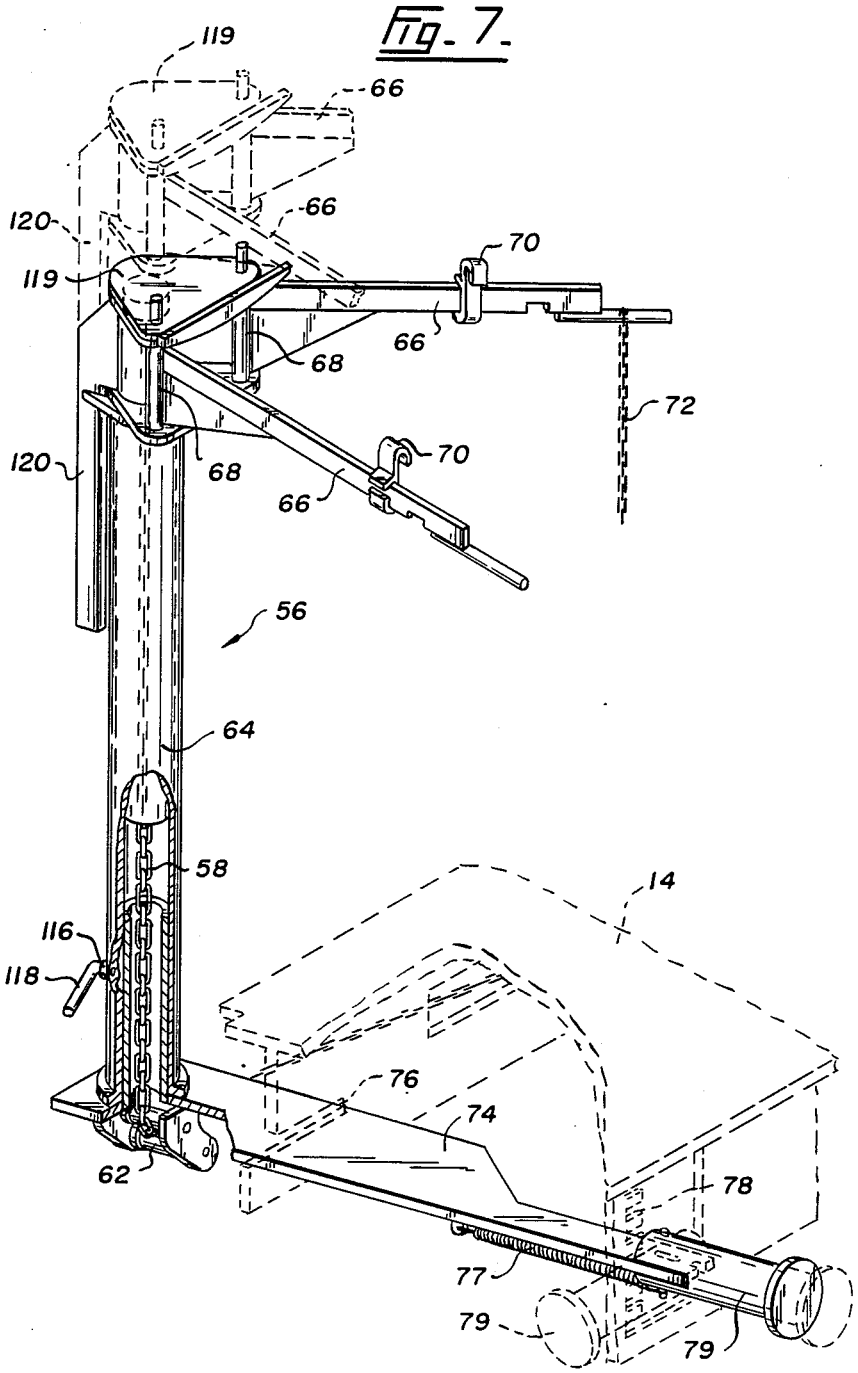
FIG. 7 shows the spring compressor of the apparatus of the present invention.

The apparatus includes a spring compressor 56 as shown particularly in FIG. 7. This compressor 56 is also operated by the pull tower 12. However, the first chain 46 is repositioned for use in the spring compressor as shown particularly in FIG. 3. The chain 46 is engaged with a second chain 58 when the spring compressor 56 is to be used. The second chain 58 extends over a guide 60, through the base 14, upwardly over guides 62 into a telescopic tower member 64. At the top, the tower member 64 is provided with outwardly extending arms 66, pivotably mounted at 68 and provided with brackets 70 to engage the coils of a spring. A safety chain 72 is incorporated to prevent the spring from moving violently, should the apparatus slip on the spring. Chain 72 extends between arms 66 to prevent inadvertent parting of the arms.

As shown particularly in FIG. 7 the tower member 64 is mounted on a plate 74 extending laterally through the base 14 and engaged at one side in a slot 76. At the other side the plate 74 is mounted, as required, in one of a plurality of openings 78. By selecting an opening 78, the angle of the plate 74 and thus of the tower 64, can be selected. The plate 74 is provided with a handle 79 which is rotatable. When the plate 74 is in use the handle 79 is extended, as shown in solid lines in FIG. 7. To release the handle 79 the handle is pulled outwardly, against the force of a spring 77 and then rotated to the broken line position as shown in FIG. 7 where it is stored, against the side of the table.

As shown particularly in FIG. 6 the apparatus desirably includes a reaction member 80 which is located by a lockable, movable sleeve 82 on tower 12. Locking is achieved by rotation of the threaded member 84, using handle 86, to lock the sleeve 82 in position on the tower 12. Lock pins 85 hold the sleeve 82 together where it is attached to member 80. The pivotably mounted member 80 extends outwardly and can be used to abut a strut, as shown particularly in FIG. 6, to control the necessary straightening of the strut and, in particular, to locate the straightening effect. The end 88 of the reaction member 80 is desirably threaded so that it may be extended or retracted as required.

Figure 3:
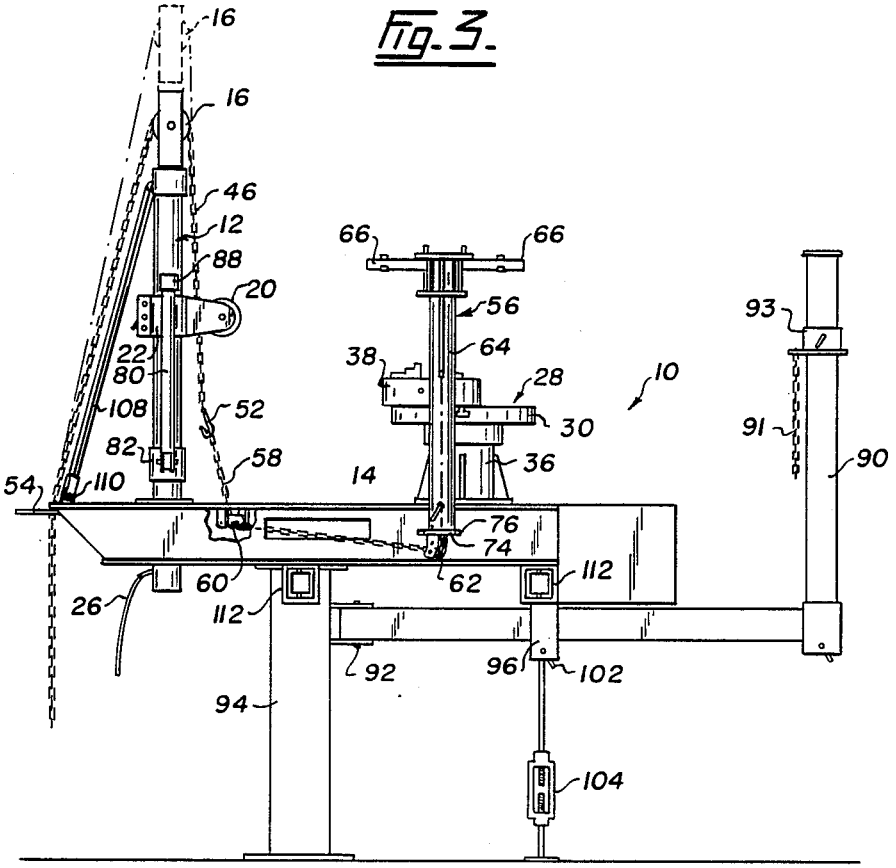
FIG. 3 is a further side view showing the spring compressor in an operable position.

As shown mainly in FIGS. 2 and 3 the apparatus includes a second tower 90 on that side of the base remote from the pull tower 12. The second tower 90 is optional. It is pivotably mounted at 92 on a central column 94 of the base 14 and extends outwardly from the pivotal mount 92 through a bracket 96. It can act as a holding post for a chain 91 attached to anchor 93. Chain 91 is used to hold components mounted on table 28 while the component is straightened.

Figure 5:
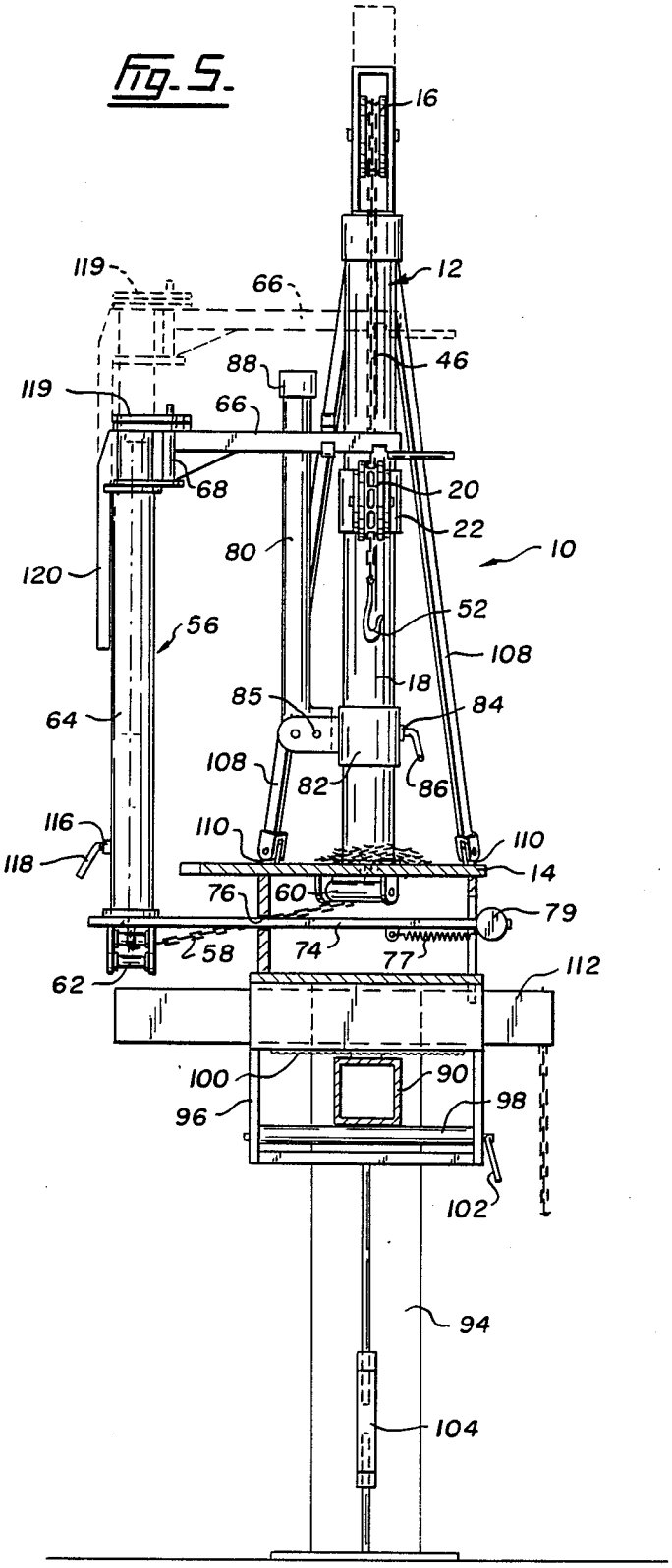
FIG. 5 is an end elevation of the apparatus of the present invention.

The level position of the second tower 90 is controlled by a cam member 98 and its angle of rotation is controlled by the provision of teeth on its upper surface engaging in corresponding teeth 100 on the lower surface of the base 14. These teeth 100 are forced into engagement by the cam member 98, which is rotated by handle 102 shown in FIG. 5.

The base can be prevented from tilting under a force by turn buckle member 104.

As shown particularly in FIG. 6 the pneumatic cylinder 24 is located by a simple pin 106 extending through opening in tower 12. This allows easy removal of cylinder 24 which can be used separately from tower 12, for example to force wheel bearings from the vehicle wheel hubs, especially in front wheel drive cars.

The tower 12 is braced by members 108 anchored to the table at 110. The hub can be supported in a stand mounted on table 28.

There are also lateral members 112 extending outwardly from base 14 as shown particularly in FIGS. 1 and 2. There are chain locating slots 114 in each lateral member 112 which will be the same configuration as shown in a detail in FIG. 4. Chains attached to lateral members 112 can be used to hold relatively lengthy articles, for example, chassis cross-members during straightening of the relatively lengthy article.

Using the apparatus of the present invention, for example, to straighten a strut, first it would be usual to remove the spring from the McPherson strut. To this end the strut would be placed on the table, for example as shown in FIG. 2 or FIG. 6. The height of the column 64 would be adjusted as necessary, as shown in FIG. 7, by lifting the arms 66 to the appropriate height. The arms 66 can then be pivoted inwardly so that brackets 70 can engage the spring. Pivoting of the tower is achieved by unlocking it at 116, using handle 118 and rotating the tower to the appropriate position. Safety chain 72 is engaged. Second chain 58 is engaged with first chain 46. Air is applied to the pneumatic cylinder 24 to extend pulley 16 upwardly. The first chain 46 is engaged in slot 50, prior to applying air pressure to the cylinder 24. As a result of the above, pull is exerted on the chain 58 which moves the arms 66 downwardly to compress the spring. The upper bracket 119 on the tower 64 as shown in FIG. 7 is guided by the external finger 120 extending downwardly. When the spring is compressed the stops on the spring are removed in conventional manner and the spring extended to be removed from the strut.

Once the strut has been freed of its spring it may be measured to determine precisely where the distortion has occurred. It may be in the tube of the strut, it may be in a steering knuckle or in any part of the steering or suspension component. Once the appropriate measurements have been made the strut, or the distorted component may be mounted on the table 30 for the appropriate corrections to be made. For example, if the tube is bent than the strut may be mounted as shown in FIG. 6 using bracket 44 attached to mounting member 42, or it may be mounted directly to chuck 38 as shown in FIG. 2. If necessary, the reaction member 80 is moved into appropriate position, as shown in FIG. 6, and chain 46 is then looped around the tube. Air pressure is then applied to cylinder 24 to pull the tube in the direction of tower 12 as shown in FIG. 6. If necessary, the table 30 can be rotated 180° by way of tower 36 to allow pull in opposite directions.

Using the same technique any steering or suspension component can be straightened. The device is simply mounted on the table 30, using an appropriate adaptor. If necessary, simple adaptors can be designed to hold the appropriate component while the force is applied. Such adaptors will be provided with T-shaped projections to engage in the T-shaped inserts 32 in the table 32.

The present invention provides a simple yet extremely powerful and robust piece of equipment that, by the use of adaptors of the appropriate configuration can be used to straighten any steering component or suspension component of a modern automobile.

The embodiments of the invention in which an exclusive property or privilege is claimed are defined as follows:

1. An apparatus for straightening an unmounted automotive component comprising:

a pneumatic pull tower mounted at one end of a base and having a first pulley mounted on a movable ram sleeve in said tower and a second pulley movably mounted along said tower;

a driving cylinder housed in said pull tower for applying a force to move said ram sleeve;

component securing means mounted at a second end of said base and adapted to fixedly receive said component;

a pivotable spring compressing column adjacent said component securing means having means for unloading spring tension from a component;

a first chain for connecting at one end to said component and at another end to said base, said chain being led along said first and second pulleys such that when said driving cylinder is activated, said ram sleeve will apply a force on said chain to straighten said component.

2. An apparatus as defined in claim 1 wherein said componet securing means comprises a rotatable tower mounted to said base supporting a table having a plurality of securing positions to permit a bent component to be rotated and straightened according to the direction of the bend.

3. An apparatus as defined in claim 1 wherein said means for unloading spring tension comprises a retractable sleeve mounted in said column having at its upper end means for holding said spring and having at its lower end a tensioning chain led below said base along a first roller positioned below said column and a second roller positioned below said pull tower and through an opening in said base such that upon attaching said first chain to said tensioning chain, spring tension on said strut can be unloaded.

4. An apparatus as defined in claim 3 wherein said means for holding said spring comprises a pair of inwardly pivotable arms having attached brackets for engaging the coils of said spring, said pivotable arms having safety means for securing said brackets to said spring.

5. An apparatus as defined in claim 1 including means to adjust the inclination of said pivotable spring comprssing column.

6. An apparatus as claimed in claim 5, in which said pivotable spring compressing column is mounted on a plate extending through said base with means to vary the position of said plate at a side of said base remote from said column to allow variation in the inclination of said column.

7. An apparatus as claimed in claim 6 in which said plate is provided with a handle.

8. An apparatus as claimed in claim 7 in which the handle is pivotable between an operating position extending from the plate and a rest position against the base.

9. An apparatus as claimed in claim 1 in which said component securing means includes a plurality of channels formed in said table;

a component gripping element formed with a projection to be received in one of said channels.

10. An apparatus as claimed in claim 9 in which the channels and projections are correspondingly T-shaped.

11. An apparatus as claimed in claim 9 in which said component gripping element is an adaptor to receive a McPherson strut.

12. An apparatus as claimed in claim 9 in which said component gripping element is a vice.

13. An apparatus as claimed in claim 9 in which said component gripping element is a chuck.

14. An apparatus as claimed in claim 1 including a reaction member extending from the pull tower to contact the component to restrict bending of the component.

15. An apparatus as claimed in claim 14 in which the reaction member is slidably, lockably mounted on the pull tower.

16. An apparatus as claimed in claim 1 including a second tower on that side of the base remote from the pull tower.

17. An apparatus as claimed in claim 16 including means to vary the position of the second tower and to lock the tower in a predetermined position.

18. An apparatus as claimed in claim 1 including lateral members extending outwardly from the base;

chain locating means in each lateral member.

* * * * *